US005139997A

United States Patent [19]

Bach et al.

[11] Patent Number: 5,139,997

[45] Date of Patent: Aug. 18, 1992

[54] TRANSFER OF BICHROMOPHORIC CYANO-CONTAINING METHINE DYES

[75] Inventors: Volker Bach, Neustadt; Karl-Heinz Etzbach, Frankenthal; Ruediger Sens, Mannheim, all of Fed. Rep. of Germany

[73] Assignee: BASF Aktiengesellschaft, Ludwigshafen, Fed. Rep. of Germany

[21] Appl. No.: 650,430

[22] Filed: Feb. 4, 1991

[30] Foreign Application Priority Data

Feb. 15, 1990 [DE] Fed. Rep. of Germany ..... 4004614

[51] Int. Cl.[5] ..... B41M 5/035; B41M 5/26

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS

| | | | |
|---|---|---|---|
| 3,846,069 | 11/1974 | Angliker et al. | 8/471 |
| 4,018,810 | 4/1977 | Skoog | 260/465 |
| 4,748,149 | 5/1988 | Byers | 503/227 |
| 4,833,123 | 5/1989 | Hashimoto et al. | 503/227 |

FOREIGN PATENT DOCUMENTS

| | | | |
|---|---|---|---|
| 535131 | 3/1973 | Switzerland | 8/471 |

*Primary Examiner*—Bruce H. Hess

*Attorney, Agent, or Firm*—Oblon, Spivak, McClelland, Maier & Neustadt

[57] ABSTRACT

Bichromophoric methine transfer dyes of the formula

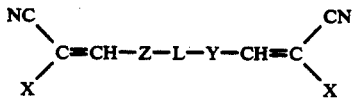

where

L is a bridge member which does not permit any conjugation of $\pi$-electrons between Z and Y, X is cyano, $C_1$–$C_6$-alkoxycarbonyl or $C_1$–$C_6$-monoalkylcarbamoyl, wherein alkyl may in each case be interrupted by oxygen atoms, or is $C_5$–$C_7$-cycloalkoxycarbonyl, $C_5$–$C_7$-monocycloalkylcarbamoyl, phenoxycarbonyl or monophenylcarbamoyl, Y and Z are each independently of the other aminophenylene, which may be benzo-fused, or heterocyclyl, are transferable from a transfer to a sheet of plastic-coated paper with the aid of an energy source.

2 Claims, No Drawings

TRANSFER OF BICHROMOPHORIC CYANO-CONTAINING METHINE DYES

The present invention relates to a novel process for transferring dichromophoric cyano-containing methine dyes composed of two individual chromophores linked together via a bridge member from a transfer to a sheet of plastic-coated paper with the aid of an energy source.

In the thermotransfer printing process, a transfer sheet which contains a thermally transferable dye in one or more binders on a support with or without suitable assistants is heated from the back with an energy source, e.g. a thermal printing head, in short pulses (lasting fractions of a second), causing the dye to migrate out of the transfer sheet and to diffuse into the surface coating of a receiving medium. The essential advantage of this process is that the amount of dye to be transferred (and hence the color gradation) is readily controllable through adjustment of the energy supply from the energy source.

In general, color recording is carried out using the three subtractive primaries yellow, magenta and cyan (with or without black). To ensure optimal color recording, the dyes must have the following properties:

ready thermal transferability, little tendency to migrate within or out of the surface coating of the receiving medium at room temperature, high thermal and photochemical stability and resistance to moisture and chemical substances, suitable hues for subtractive color mixing, a high molar absorption coefficient, no tendency to crystallize out on storage of the transfer sheet.

From experience these requirements are very difficult to meet at one and the same time.

For this reason, most of the existing thermal transfer printing dyes do not meet the required property profile.

It is an object of the present invention to provide a novel process for the transfer of dyes, in which the dyes used are bichromophoric cyano-containing methine dyes which should substantially meet the above requirements. We have found that this object is achieved by a process for transferring a bichromophoric methine dye from a transfer to a sheet of plastic-coated paper with the aid of an energy source, which comprises using a transfer on which there is or are one or more dyes of the formula I

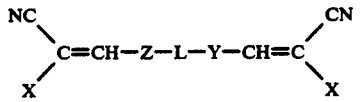

(I)

where

L is a bridge member which does not permit any conjugation of $\pi$-electrons between Z and Y, X is identical or different in its two appearances, denoting in each case cyano, $C_1$–$C_6$-alkoxycarbonyl or $C_1$–$C_6$-monoalkylcarbamoyl, wherein alkyl may in each case be interrupted by 1 or 2 oxygen atoms, or $C_5$–$C_7$-cycloalkoxycarbonyl, $C_5$–$C_7$ -monocycloalkylcarbamoyl, phenoxycarbonyl or monophenylcarbamoyl, and Z and Y are identical or different and, together with the bridge member L, are each independently of the other a radical of the formula

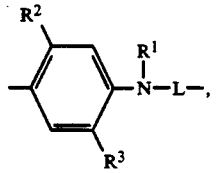

(IIa)

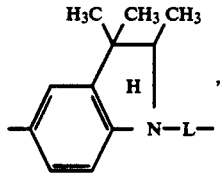

(IIb)

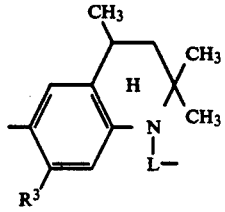

(IIc)

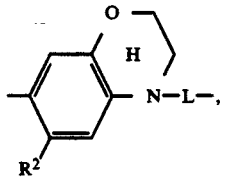

(IId)

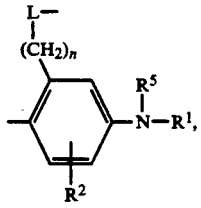

(IIe)

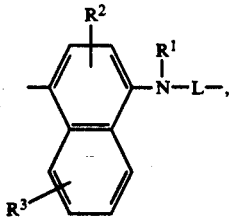

(IIf)

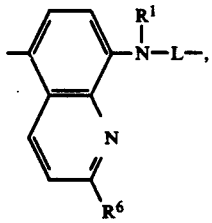

(IIg)

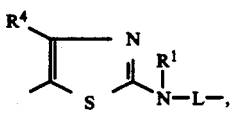

(IIh)

-continued (IIi)

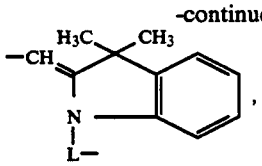

(IIj)

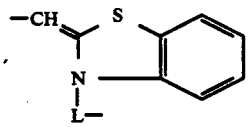

or (IIk)

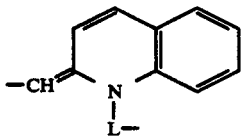

where n is 0 or 1, $R^1$ and $R^5$ are identical or different and each is independently of the other alkyl, alkoxyalkyl, alkoxycarbonylalkyl or alkanoyloxyalkyl, which may each have up to 10 carbon atoms and be hydroxyl- or cyano-substituted, hydrogen, benzyl, cyclohexyl, phenyl or tolyl, $R^2$ and $R^3$ are identical or different and each is independently of the other $C_1$–$C_8$-alkyl, $C_1$–$C_8$-alkoxy, $C_1$–$C_6$-alkanoylamino or $C_1$–$C_6$-alkylsulfonylamino, $R^4$ is hydrogen, halogen, $C_1$–$C_8$-alkyl, unsubstituted or $C_1$-alkyl- or $C_1$–$C_4$-alkoxy-substituted phenyl, unsubstituted or $C_1$–$C_4$-alkyl- or $C_1$–$C_4$-alkoxy-substituted benzyl, cyclohexyl, thienyl or —$NHR^1$, where $R^1$ is as defined above, and $R^6$ is hydrogen or $C_1$–$C_8$-alkyl.

The bridge member L, which does not permit any conjugation of $\pi$-electrons between Z and Y, generally conforms to the formula $$-E^1-D-E^2-$$

where

D is a chemical bond, oxygen, —$SO_2$—, —O—CO—O—, 1,4-cyclohexylene, phenylene, —O—CO—$(CH_2)_l$—CO—O—, —O—$(CH_2)_m$—O—,

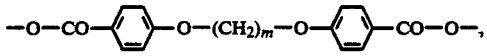

where l is from 1 to 10 and m is from 2 to 10,

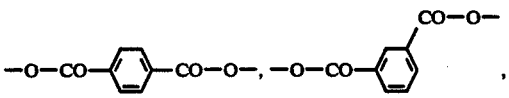

and

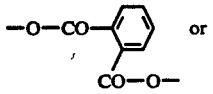

$E^1$ and $E^2$ are identical or different and each is independently of the other a chemical bond or $C_1$–$C_{15}$-alkylene.

Any alkyl or alkylene appearing in the abovementioned formulae may be either straight-chain or branched.

A suitable $R^1$, $R^2$, $R^3$, $R^4$, $R^5$ or $R^6$ is for example methyl, ethyl, propyl, isopropyl, butyl, isobutyl, secbutyl, tert-butyl, pentyl, isopentyl, neopentyl, tertpentyl, hexyl, 2-methylpentyl, heptyl, octyl, 2-ethylhexyl or isooctyl.

$R^1$ and $R^5$ may each also be for example nonyl, isononyl, decyl, isodecyl, 2-methoxyethyl, 2-ethoxyethyl, -propoxyethyl, 2-butoxyethyl, 2- or 3-methoxypropyl, 2- or 3-ethoxypropyl, 2- or 3-propoxypropyl, 2- or 3-butoxypropyl, 4-methoxybutyl, 4-ethoxybutyl, 4-butoxybutyl, 2cyanoethyl, 3-cyanopropyl, 4-cyanobutyl, 2-hydroxyethyl,

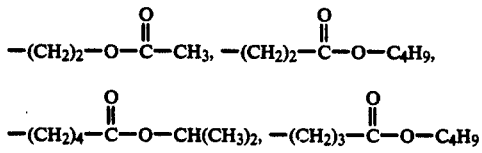

$R^4$ may also be for example phenyl, 2-, 3- or 4methylphenyl, 2- or 4-iscpropylphenyl, 2-butylphenyl, 2-, 3- or 4-methoxyphenyl, 2-propoxyphenyl, 4-butoxyphenyl, 2-(but-2-oxy)phenyl, benzyl, 2-, 3- or 4-methylbenzyl, 2-, 3- or 4-methoxybenzyl, fluorine, chlorine, bromine, 2-thienyl or 3-thienyl.

$R^2$ and $R^3$ may each also be methoxy, ethoxy, propoxy, isopropoxy, tutoxy, isobutoxy, sec-butoxy, pentyloxy, isopentyloxy, neopentyloxy, hexyloxy, formylamino, acetylamino, propionylamino, butyrylamino, methylsulfonylamino, ethylsulfonylamino, propylsulfonylamino, isopropylsulfonylamino or butylsulfonylamino.

X is for example methoxycarbonyl, ethoxycarbonyl, propoxycarbonyl, isopropoxycarbonyl, butoxycarbonyl, 2-methoxyethoxycarbonyl,methylcarbamoyl,ethylcarbamoyl, 2-methoxyethylcarbamoyl, cyclopentyloxycarbonyl, cyclohexyloxycarbonyl, cycloheptyloxycarbonyl, cyclopentylcarbamoyl, cyclohexylcarbamoyl or cycloheptylcarbamoyl.

$E^1$ and $E^2$ are each for example methylene, 1,2-ethylene, ethylidene, 1,2- or 1,3-propylene or 1,4-, 1,3-or 2,3-butylene.

D is for example

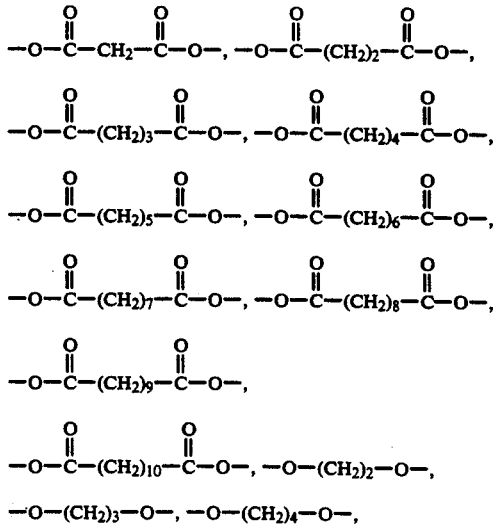

-continued $-O-(CH_2)_5-O-$, $-O-(CH_2)_6-O-$, $-O-(CH_2)_7-O-$, $-O-(CH_2)_8-O-$, $-O-(CH_2)_9-O-$, $-O-(CH_2)_{10}-O-$,

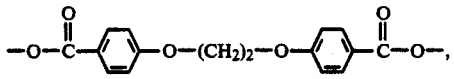

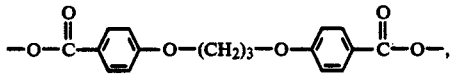

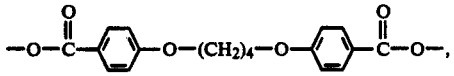

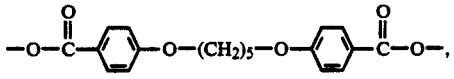

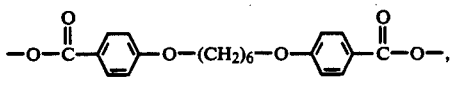

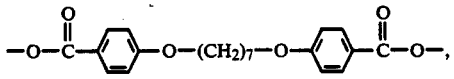

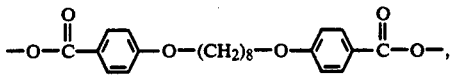

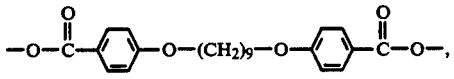

or

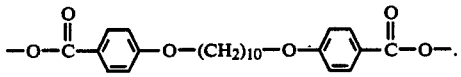

Advantageous results are obtained on transferring one or more methine dyes of the formula I in which Z and Y each conform to the formula IIa, IIb, IIc, IId, IIe, IIf or IIg.

Good results are also obtained on transferring one or more methine dyes of the formula I in which $R^1$ and $R^5$ are each independently of the other hydrogen, $C_1$–$C_6$-alkyl or cyclohexyl, $R^2$ and $R^3$ are each independently of the other hydrogen, methyl, methoxy or acetylamino, $R^4$ is hydrogen, $C_1$–$C_6$-alkyl or unsubstituted or methyl- or methoxy-substituted phenyl, 2-thienyl or 3-thienyl, and $R^6$ is hydrogen or $C_1$–$C_6$-alkyl.

Particularly good results are obtained on transferring one or more methine dyes of the formula I in which the bridge member L has the formula $$-E^1-D-E^2-$$

where $E^1$ and $E^2$ are each independently of the other $C_1$–$C_4$-alkylene and D is a chemical bond, oxygen, $-SO_2-$, $-O-CO-(CH_2)_l-CO-O$, where l is from 2 to 4, where l is from 2 to 4,

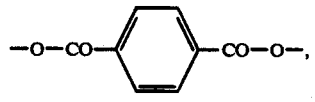

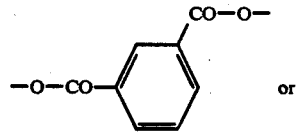

or

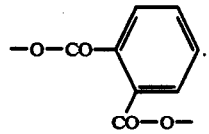

Particularly good results are also obtained on transferring one or more methine dyes of the formula I in which X is cyano.

The bichromophoric methine dyes employed in the process according to the present invention are in general known and described for example in GB-A-1,201,925, U.S. Pat. No. 3,553,245, DE-A-1,569,678, DE-A-2,519,592, DE-A-3,020,473, WO-A-86/04904 and WO-A-87/01121, or can be obtained by the methods mentioned therein.

Compared with the dyes used in existing processes, the dyes transferred in the process according to the invention are notable in general for improved fixation in the receiving medium at room temperature, readier thermal transferability, higher lightfastness, higher stability to moisture and chemical substances, better solubility in organic solvents, higher inked ribbon stability and higher purity of hue.

It is also surprising that the dyes of the formula I are readily transferable and that they have a high inked ribbon stability, despite their high molecular weight.

Owing to their high molar extinction coefficients and their high brilliance, the dyes of the formula I employed in the novel process are advantageously suitable for preparing a trichromatic system as required for subtractive color mixing.

In addition, the ready transferability permits wide variation of the receiver or acceptor plastics, and thus makes possible very efficient adaptation of the dyes within the overall system of donor/receiver.

To prepare the dye transfers required in the process according to the present invention, the dyes are incorporated into a suitable organic solvent or solvent mixture together with one or more binders and possibly further assistants to form a printing ink in which the dye is preferably present in a molecularly dispersed, dissolved, form. The printing ink is then applied to an inert support by knife coating and dried in air.

Suitable organic solvents for the dyes I are for example those in which the solubility of the dyes I at 20° C. is greater than 1% by weight, preferably greater than 5% by weight.

Examples are ethanol, propanol, isobutanol, tetrahydrofuran, methylene chloride, methyl ethyl ketone, cyclopentanone, cyclohexanone, toluene, chlorobenzene and mixtures thereof.

Suitable binders are all resins or polymer materials which are soluble in organic solvents and are capable of binding the dye to the inert support in a form in which it will not rub off. Preference is given here to those binders which, after the printing ink has dried in air, hold the dye in a clear, transparent film in which no visible crystallization of the dye occurs.

Examples of such binders are cellulose derivatives, eg. methylcellulose, ethylcellulose, ethylhydroxyethylcellulose, hydroxypropylcellulose, cellulose acetate and cellulose acetobutyrate, starch, alginates, alkyd resins, vinyl resins, polyvinyl alcohol, polyvinyl acetate, polyvinyl butyrate and polyvinylpyrrolidones. It is also possible to use polymers and copolymers of acrylates or derivatives thereof, such as polyacrylic acid, polymethyl methacrylate or styrene/acrylate copolymers, polyester resins, polyamide resins, polyurethane resins or natural CH resins, such as gum arabic. Other suitable binders are described for example in DE-A-3,524,519.

Preferred binders are ethylcellulose, ethylhydroxyethylcellulose, polyvinyl butyrate and polyvinyl acetate.

The weight ratio of binder:dye is in general within the range from 1:1 to 10:1.

Suitable assistants are for example release agents as mentioned in EP-A-227,092, EP-A-192,435 and the patent applications cited therein. It is also possible to include in particular organic additives which prevent the transfer dyes from crystallizing out in the course of storage or heating of the inked ribbon, for example cholesterol or vanillin.

Inert support materials are for example tissue, blotting or parchment paper and plastics films possessing good heat resistance, for example metallized or unmetallized polyester, polyamide or polyimide. The inert support may additionally be coated on the side facing the thermal printing head with a lubricant or slipping layer in order that adhesion of the thermal printing head to the support material may be prevented. Suitable lubricants are described for example in EP-A-216,483 and EP-A-227,095. The thickness of the support is in general from 3 to 30 μm, preferably from 5 to 10 μm.

The dye-receiving medium can be basically any heat resistant plastics layer having affinity for the dyes to be transferred, for example a modified polycarbonate or polyester. Suitable recipes for the receiving layer composition are described in detail for example in EP-A-227,094, EP-A-133,012, EP-A-133,011, EP-A-111,004, JP-A-199,997/1986, JP-A-283,595/1986, JP-A-237,694/1986 and JP-A-127,392/1986.

Transfer is effected by means of an energy source, e.g. a laser or a thermal printing head which must be heatable to ≧300° C. in order that dye transfer may take place within the time range t:0<t<15 msec. In the course of transfer, the dye migrates out of the transfer sheet and diffuses into the surface coating of the receiving medium.

The Examples which follow further illustrate the present invention. Percentages are by weight, unless otherwise stated.

For a simple quantitative examination of the transfer characteristics of the dyes, the thermal transfer was effected with large hotplates instead of a thermal printing head, the transfer temperature being varied within the range 70° C.<T<120° C. while the transfer time was fixed at 2 minutes.

α) General recipe for coating the support with dye 1 g of binder was dissolved in 8 ml of 8:2 v/v toluene/ethanol at 40–50° C. A solution of 0.25 g of dye in 5 ml of tetrahydrofuran was added with stirring, and any insolubles were filtered off. The print paste thus obtained was applied with an 80 μm doctor blade to a polyester sheet (thickness: 6–10 μm) and dried with a hairdryer.

β) Testing of thermal transferability The dyes used were tested as follows: The polyester sheet donor containing the dye under test in the coated front was placed face down on commercial receiver paper (specified hereinafter) and pressed down. Donor/receiver were then wrapped in aluminum foil and heated between two hotplates at various temperatures T (within the temperature range 70° C.<T<120° C). The amount of dye diffusing into the bright plastics coating of the receiver is proportional to the optical density (=absorbance A). The latter was determined photometrically. A plot of the logarithm of the absorbance A of the colored receiver papers measured within the temperature range from 80° to 110° C. against the reciprocal of the corresponding absolute temperature is a straight line from whose slope it is possible to calculate the activation energy $\Delta E_T$ for the transfer experiment:

$$\Delta E_T = 2{,}3 \cdot R \cdot \frac{\Delta \log A}{\Delta\left[\frac{1}{T}\right]}$$

To complete the characterization, it is additionally possible to read from the plots the temperature T* [° C.] at which the absorbance A of the colored receiver papers attains the value 1.

The dyes listed in the tables below were processed according to α), and the dye-coated transfers obtained were tested for their transfer characteristics according to β). The Tables show in each case the thermal transfer parameters T* and $\Delta E_T$, the absorption maxima of the dyes $\lambda_{max}$ (measured in methylene chloride), the binders used and the weight ratio of dye:binder:assistant.

The key to the abbreviations is as follows:

D=dye
B=binder
EC=ethylcellulose
PVB=polyvinyl butyrate
Cellit=cellulose acetobutyrate
HCVPP=Hitachi Color Video Print Paper (receiver)
PBTP=polybutylene terephthalate film (receiver)
SV 100=Color Video Print Paper/Kodak AG (receiver)

TABLE 1

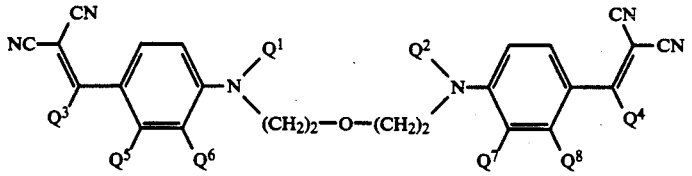

| Ex. No. | $Q^1$ | $Q^2$ | $Q^3$ | $Q^4$ | $Q^5$ | $Q^6$ | $Q^7$ | $Q^8$ | $\lambda_{max}$ [nm] | B | D:B | Receiver | T* [°C.] | $\Delta E_T$ [kJ/mol] |
|---|---|---|---|---|---|---|---|---|---|---|---|---|---|---|
| 1 | $C_2H_5$ | $C_2H_5$ | H | H | $CH_3$ | H | H | $CH_3$ | 447 | EC | 1:4 | HCVPP | 45 | 55 |
| 2 | $C_2H_5$ | $C_2H_5$ | H | H | $CH_3$ | H | H | $CH_3$ | 447 | EC | 1:10 | HCVPP | 61 | 63 |
| 3 | $C_2H_5$ | $C_2H_5$ | H | H | $CH_3$ | H | H | $CH_3$ | 447 | EC | 1:20 | HCVPP | 93 | 96 |
| 4 | $C_2H_5$ | $C_2H_5$ | H | H | $CH_3$ | H | H | $CH_3$ | 447 | EC | 1:10 | PBTP | 87 | 60 |
| 5 | $C_2H_5$ | $C_2H_5$ | H | H | $CH_3$ | H | H | $CH_3$ | 447 | PVB | 1:10 | PBTP | 96 | 45 |
| 6 | $C_2H_5$ | $C_2H_5$ | H | H | $CH_3$ | H | H | $CH_3$ | 447 | EC | 1:4 | SV 100 | 58 | 137 |

TABLE 2

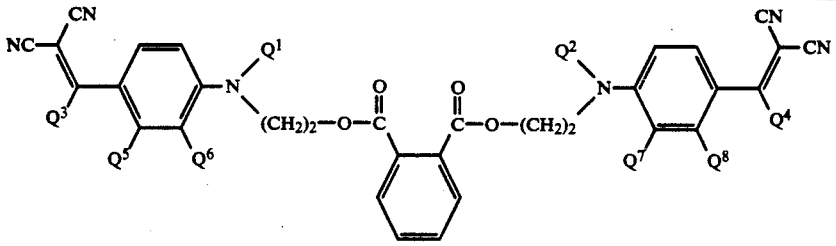

| Ex. No. | $Q^1$ | $Q^2$ | $Q^3$ | $Q^4$ | $Q^5$ | $Q^6$ | $Q^7$ | $Q^8$ | $\lambda_{max}$ [nm] | B | D:B | Receiver | T* [°C.] | $\Delta E_T$ [kJ/mol] |
|---|---|---|---|---|---|---|---|---|---|---|---|---|---|---|
| 7 | $CH_3$ | $CH_3$ | H | H | H | H | H | H | 427 | — | — | — | — | — |
| 8 | $C_2H_5$ | $C_2H_5$ | H | H | H | H | H | H | 429 | EC | 1:4 | HCVPP | 110 | 54 |
| 9 | $C_2H_5$ | $C_2H_5$ | H | H | $CH_3$ | H | H | $CH_3$ | 439 | EC | 1:4 | HCVPP | 88 | 99 |
| 10 | $C_2H_5$ | $C_2H_5$ | H | H | $CH_3$ | H | H | $CH_3$ | 439 | EC | 1:4 | SV 100 | 95 | 134 |

TABLE 3

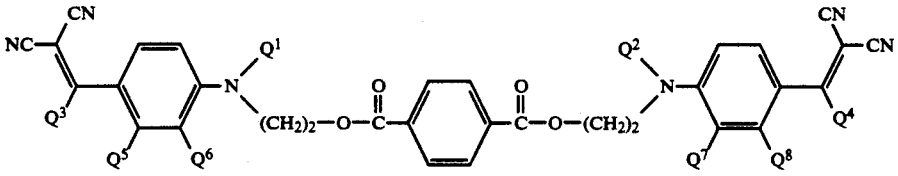

| Ex. No. | $Q^1$ | $Q^2$ | $Q^3$ | $Q^4$ | $Q^5$ | $Q^6$ | $Q^7$ | $Q^8$ | $\lambda_{max}$ [nm] | B | D:B | Receiver | T* [°C.] | $\Delta E_T$ [kJ/mol] |
|---|---|---|---|---|---|---|---|---|---|---|---|---|---|---|
| 11 | $C_2H_5$ | $C_2H_5$ | H | H | H | H | H | H | 429 | Cellit | 1:4 | HCVPP | 92 | 67 |
| 12 | $C_2H_5$ | $C_2H_5$ | H | H | H | H | H | H | 429 | Cellit | 1:4 | PBTP | 115 | 91 |
| 13 | $C_2H_5$ | $C_2H_5$ | H | H | $CH_3$ | H | H | $CH_3$ | 440 | EC | 1:4 | SV 100 | 113 | 110 |

TABLE 4

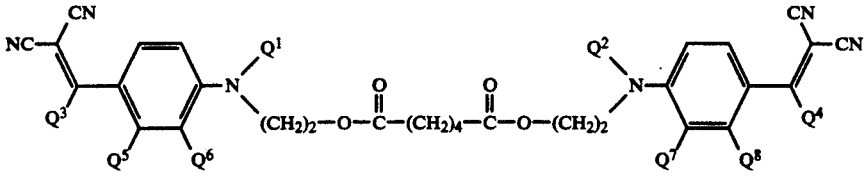

| Ex. No. | $Q^1$ | $Q^2$ | $Q^3$ | $Q^4$ | $Q^5$ | $Q^6$ | $Q^7$ | $Q^8$ | $\lambda_{max}$ [nm] | B | D:B | Receiver | T* [°C.] | $\Delta E_T$ [kJ/mol] |
|---|---|---|---|---|---|---|---|---|---|---|---|---|---|---|
| 14 | $C_2H_5$ | $C_2H_5$ | H | H | H | H | H | $CH_3$ | 441 | EC | 1:4 | HCVPP | 71 | 63 |
| 15 | $C_2H_5$ | $C_2H_5$ | H | H | $CH_3$ | H | H | $CH_3$ | 441 | EC | 1:4 | PBTP | 119 | 54 |
| 16 | $C_2H_5$ | $C_2H_5$ | H | H | $CH_3$ | H | H | $CH_3$ | 441 | Cellit | 1:4 | SV 100 | 58 | 137 |
| 17 | $C_2H_5$ | $C_2H_5$ | H | H | $CH_3$ | H | H | $CH_3$ | 441 | EC | 1:4 | SV 100 | 91 | 100 |

TABLE 4-continued

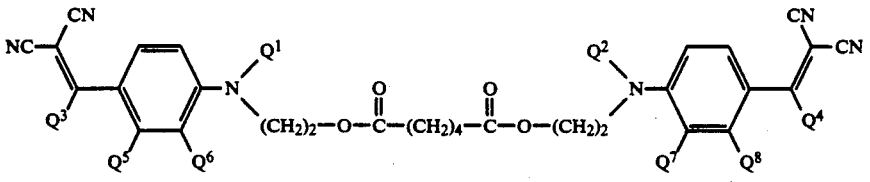

| Ex. No. | $Q^1$ | $Q^2$ | $Q^3$ | $Q^4$ | $Q^5$ | $Q^6$ | $Q^7$ | $Q^8$ | $\lambda_{max}$ [nm] | B | D:B | Receiver | T* [°C.] | $\Delta E_T$ [kJ/mol] |
|---|---|---|---|---|---|---|---|---|---|---|---|---|---|---|
| 18 | $C_2H_5$ | $C_2H_5$ | H | H | | | H | H | 430 | EC | 1:4 | HCVPP | 83 | 64 |

TABLE 5

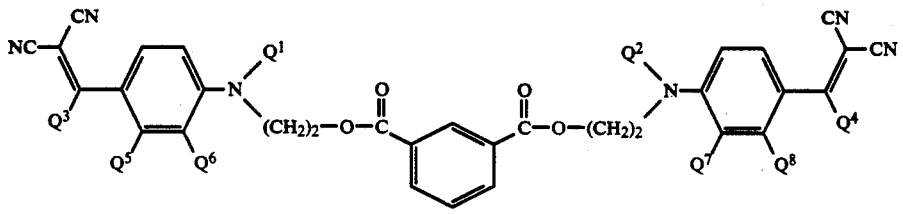

| Ex. No. | $Q^1$ | $Q^2$ | $Q^3$ | $Q^4$ | $Q^5$ | $Q^6$ | $Q^7$ | $Q^8$ | $\lambda_{max}$ [nm] | B | D:B | Receiver | T* [°C.] | $\Delta E_T$ [kJ/mol] |
|---|---|---|---|---|---|---|---|---|---|---|---|---|---|---|
| 19 | $C_2H_5$ | $C_2H_5$ | H | H | H | H | H | H | 430 | EC | 1:4 | HCVPP | 87 | 66 |

TABLE 6

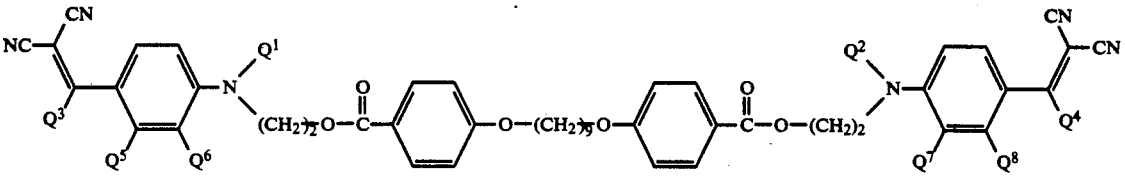

| Ex. No. | $Q^1$ | $Q^2$ | $Q^3$ | $Q^4$ | $Q^5$ | $Q^6$ | $Q^7$ | $Q^8$ | $\lambda_{max}$ [nm] | B | D:B | Receiver | T* [°C.] | $\Delta E_T$ [kJ/mol] |
|---|---|---|---|---|---|---|---|---|---|---|---|---|---|---|
| 20 | $C_2H_5$ | $C_2H_5$ | H | H | $CH_3$ | H | H | $CH_3$ | 441 | EC | 1:4 | SV 100 | 106 | 61 |
| 21 | $C_2H_5$ | $C_2H_5$ | H | H | $CH_3$ | H | H | $CH_3$ | 441 | EC | 1:4 | PBTP | 160 | 48 |
| 22 | $C_2H_5$ | $C_2H_5$ | H | H | H | H | H | H | 432 | EC | 1:4 | SV 100 | 100 | 88 |

The same method can be used to transfer the following methine dyes:

| Example No. Bsp. Nr. | |
|---|---|
| 23 | 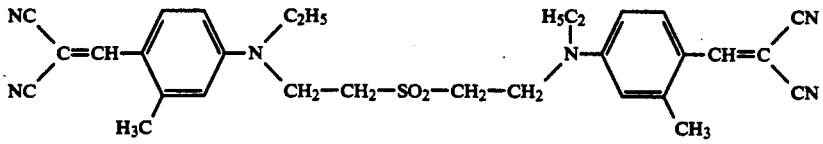 |
| 24 | 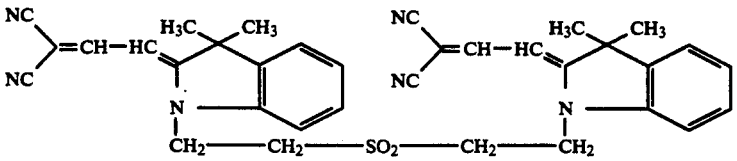 |

-continued

| Example No. Bsp. Nr. | |
|---|---|
| 25 | 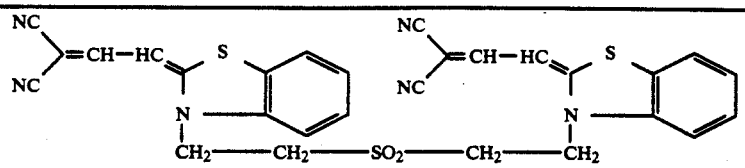 |
| 26 | 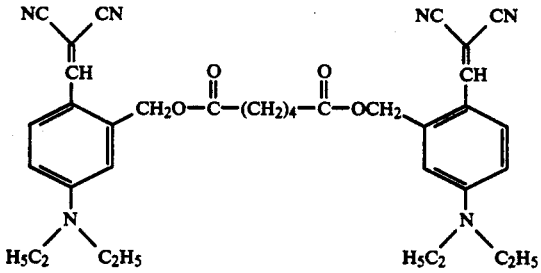 |
| 27 | 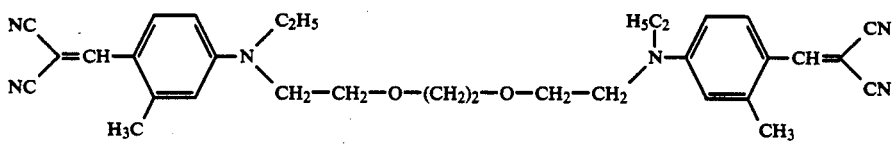 |
| 28 | 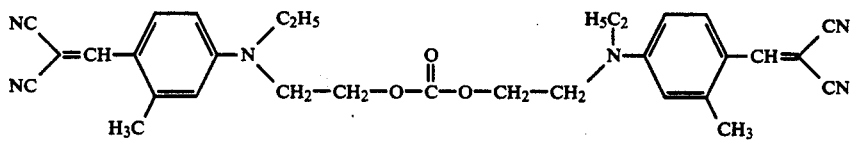 |
| 29 | 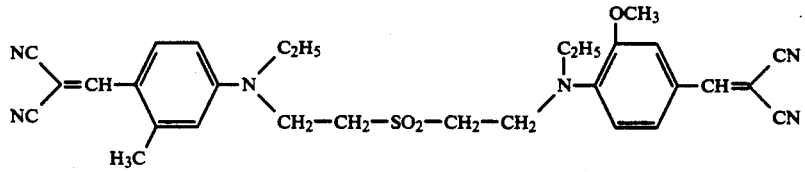 |

We claim:

1. A process for transferring a bichromophoric methine dye form a transfer to a sheet of plastic-coated paper by applying an energy source head to the back of the transfer, said transfer comprising a support, a binder and one or more dyes of the formula I

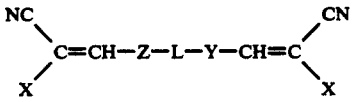

where

L is a bridge member which does not permit any conjugation of $\pi$-electrons between Z and Y, X is identical or different in its two appearances, denoting in each case cyano, $C_1$–$C_6$-alkoxycarbonyl, $C_1$–$C_6$-monoalkylcarbamoyl, wherein alkyl may in each case be interrupted by 1 or 2 oxygen atoms, $C_5$–$C_7$-cycloalkoxycarbonyl, $C_5$–$C_7$-monocycloalkylcarbamoyl, phenoxycarbonyl or monophenylcarbamoyl, Z and Y are identical or different and, together with the bridge member L, are each independently of the other a radical of the formula

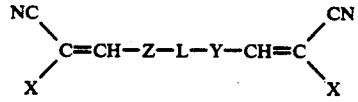

(I)

where n is 0 or 1, $R^1$ and $R^5$ are identical or different and each is independently of the other alkyl, alkoxyalkyl, alkoxycarbonylalkyl or alkanoyloxyalkyl, which may each have up to 20 carbon atoms and be hydroxyl- or cyano-substituted, hydrogen, benzyl, cyclohexyl, phenyl or toyl, $R^2$ and $R^3$ are identical or different and each is independently of the other hydrogen, $C_1$–$C_8$-alkyl, $C_1$–$C_6$-alkoxy, $C_1$–$C_6$-alkanoylamino or $C_1$–$C_6$-alkylsulfonylamino, $R^4$ is hydrogen, halogen, $C_1$–$C_8$-alkyl, unsubstituted or $C_1$–$C_4$-alkyl- or $C_1$–$C_4$-alkoxy-substituted phenyl, unsubstituted or $C_1$–$C_4$-alkyl-or $C_1$–$C_4$-alkoxy- substituted benzyl, cyclohexyl, thienyl of $-NHR^{-1}$, where $R^1$ is as defined above, and $R^6$ is hydrogen or $C_1$–$C_8$-alkyl.

2. A process as claimed in claim 1, wherein X is cyano.

* * * * *